US007827872B2

(12) United States Patent
Girgensohn et al.

(10) Patent No.: US 7,827,872 B2
(45) Date of Patent: Nov. 9, 2010

(54) APPARATUS FOR GUIDING A STRIP

(75) Inventors: Albrecht Girgensohn, Düsseldorf (DE); Andreas Runge, Remscheid (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 42 days.

(21) Appl. No.: 12/308,237

(22) PCT Filed: May 30, 2007

(86) PCT No.: PCT/EP2007/004753

§ 371 (c)(1),
(2), (4) Date: Dec. 10, 2008

(87) PCT Pub. No.: WO2007/140903

PCT Pub. Date: Dec. 13, 2007

(65) Prior Publication Data

US 2009/0301225 A1 Dec. 10, 2009

(30) Foreign Application Priority Data

Jun. 10, 2006 (DE) ..... 10 2006 027 066

(51) Int. Cl.
*G01L 1/10* (2006.01)

(52) U.S. Cl. ..... 73/862.625; 73/159

(58) Field of Classification Search . 73/862.61–862.69, 73/159–160

See application file for complete search history.

(56) References Cited

U.S. PATENT DOCUMENTS

| | | | | |
|---|---|---|---|---|
| 2,050,106 | A | 8/1936 | Lorig et al. | |
| 5,592,875 | A * | 1/1997 | Moschel | 100/99 |
| 5,758,533 | A * | 6/1998 | Quehen et al. | 72/163 |
| 7,031,797 | B2 * | 4/2006 | Reinschke et al. | 700/150 |
| 7,584,638 | B2 * | 9/2009 | Madelaine-Dupuich et al. | 72/161 |

FOREIGN PATENT DOCUMENTS

| | | |
|---|---|---|
| DE | 34 22 766 | 1/1985 |
| DE | 41 21 116 | 1/1993 |
| EP | 0 539 784 | 5/1993 |
| SU | 207155 | 8/1967 |

OTHER PUBLICATIONS

"Sensitive Measurement of Roll Separation . . . ", Steel Times Int., DMG World Media, Lewes, GB, BD. 14, No. 4, Jul. 1, 1990, p. 31, XP000161372.

* cited by examiner

*Primary Examiner*—Max Noori
(74) *Attorney, Agent, or Firm*—Lucas & Mercanti, LLP; Klaus P. Stoffel

(57) ABSTRACT

The invention relates to an apparatus and a method for guiding a strip, in particular a metal strip. Known apparatuses of this type have a carrier device (110) on which bearing blocks (120) arm fastened. Rollers (130) are rotatably mounted in the bearing blocks in order to guide the strip. So that the roller force acting on the roller in the loading case, i.e. during the guidance of the strip, can be measured in a lasting and reliable manner, it is proposed according to the invention to detect the deformation of the bearing block, in particular in the loading case, by means of a sensor device and ten to calculate the roller force required from the deformation of the bearing block by means of an evaluating device.

8 Claims, 2 Drawing Sheets

APPARATUS FOR GUIDING A STRIP

The invention concerns a device for guiding a strip, especially a metal strip, by means of one or more rolls. In this regard, the roll force that acts on the rolls during the guidance of the strip, i.e., under load, is measured.

Devices of this type are known in the prior art, e.g., from European Patent EP 0 539 784 B2, which discloses a continuous casting plant in which the rolls of a strand guide apparatus are adjusted by means of hydraulic cylinders. To measure the mechanical loads that act on the individual rolls of the strand guide apparatus during its operation, a load cell or force gauge is assigned to each roll. In this regard, the load cell is mounted between the bearing block in which the roll is supported and a segmented crosshead.

Moreover, the following documents disclose prior-art devices of the aforementioned type:

DE 41 21 116 A1,

"Sensitive measurement of roll separation forces", Steel Times International, DMG World Media, Lewes, GB, Vol. 14, No. 4, Jul. 1, 1990, p. 31, XP000161372; ISSN: 0143-7798, U.S. Pat. No. 2,050,106 A, and

DE 34 22 766 A1.

In practical terms, all of these documents disclose a device for guiding a metal strip with a bearing block, in which a roll for guiding the strip is rotatably supported. In addition, the device comprises a sensor unit for detecting deformation of the bearing block during the guidance of the strip and an evaluation unit for computing the roll force that acts on the roll from the deformation of the bearing block that is detected by the sensor unit.

Proceeding from this prior art, the objective of the invention is to further develop a known device for guiding a metal strip in such a way that, on the one hand, the sensor unit and/or the evaluation unit are located spatially close to the location of the deformation that is to be measured and that, on the other hand, they are protected from environmental influences.

This objective is achieved by the object of device claim 1. In practical terms, in accordance with the invention, the bearing block, whose deformation is being measured, has a cavity or a recess for holding the sensor unit and/or the evaluation unit.

The cavity in the bearing block offers the advantage that when the sensor unit and/or the evaluation unit is mounted in the cavity, on the one hand, it is then located spatially close to the location of the deformation of the bearing block that is to be measured and, on the other hand, it is protected there in the bearing block from environmental influences, especially moisture.

The term "strip" is used very broadly in the context of the invention. It basically means strips of any material and any cross section, including cables and threads. However, the term especially means metal strips, including, specifically, slabs.

The term "roll" is also used very broadly in the context of the invention. In principle, therefore, rolls may also be wheels or guide pulleys. However, the term is applied here especially to a strand guide roll of a strand guide apparatus, a roll of a rolling stand, or a roll of a looper or other device for the temporary storage of metal strip.

The claimed indirect method for measuring the roll force offers the advantage that it is very easily installed and yields reliable measurement results for the roll forces for an extended period of time.

A design of the sensor unit in the form of an ultrasonic sensor, an eddy-current sensor, or an optical gap sensor offers the advantageous possibility of contactless measurement of the deformation, which requires only minor design measures on the bearing block.

If the bearing block has a suitable weak point, it is advantageous if its deformation during the guidance of the strip can be easily detected by the sensor unit as representative of the deformation of the bearing block.

It is especially simple to design the weak point in the form of a slot. It is then advantageous for the sensor unit to be designed as a simple and inexpensive gap sensor, which then detects the deformation of the bearing block under load in the form of constriction of the slot.

Advantageous embodiments of the device are objects of the dependent claims.

The specification is accompanied by three figures.

The invention is described in detail below with reference to the specific embodiments illustrated in the drawings. In all of the figures, elements that are the same are identified by the same reference numbers.

Figure 1:
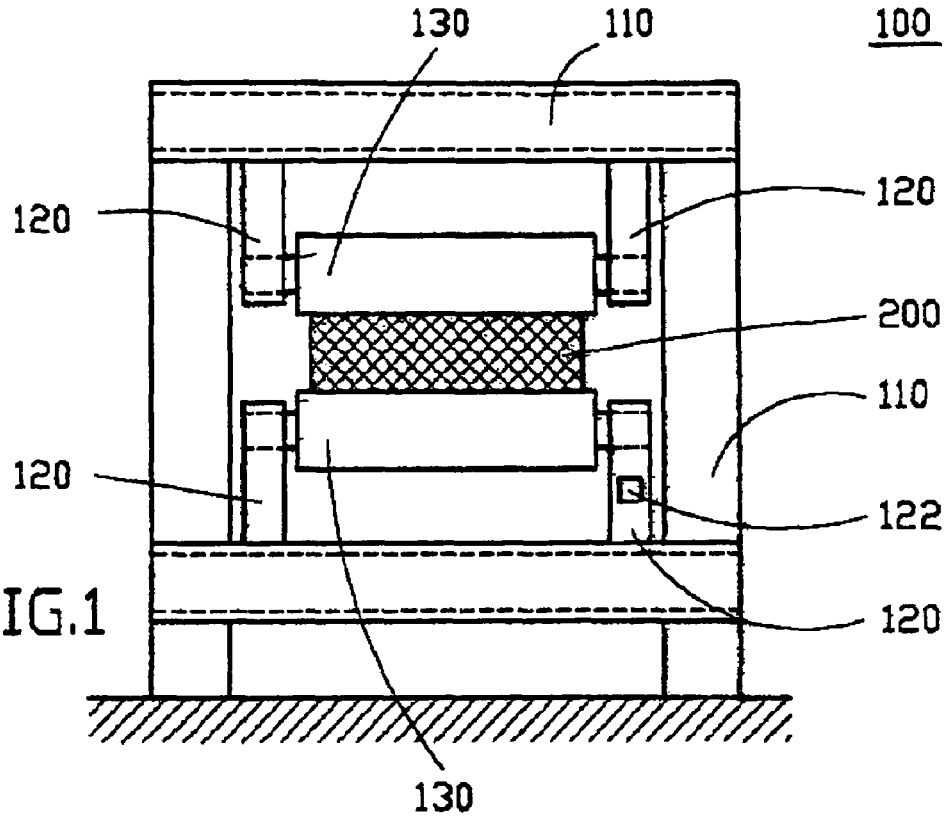
FIG. 1 shows a device for guiding a metal strip.

FIG. 1 shows a merely exemplary device 100 of the invention in the form of a strand guide apparatus. In the case illustrated here, it serves to guide a strip 200 in the form of a metal strip, especially a slab. The support apparatus 110 for this device 100 is designed as a segmented frame. Bearing blocks 120 for holding rolls 130 are mounted on the segmented frame or on its crossheads. In the strand guide apparatus shown in FIG. 1, two rolls 130 are mounted opposite each other to form a roll gap, in which the metal strip 200 is guided.

Figure 2:
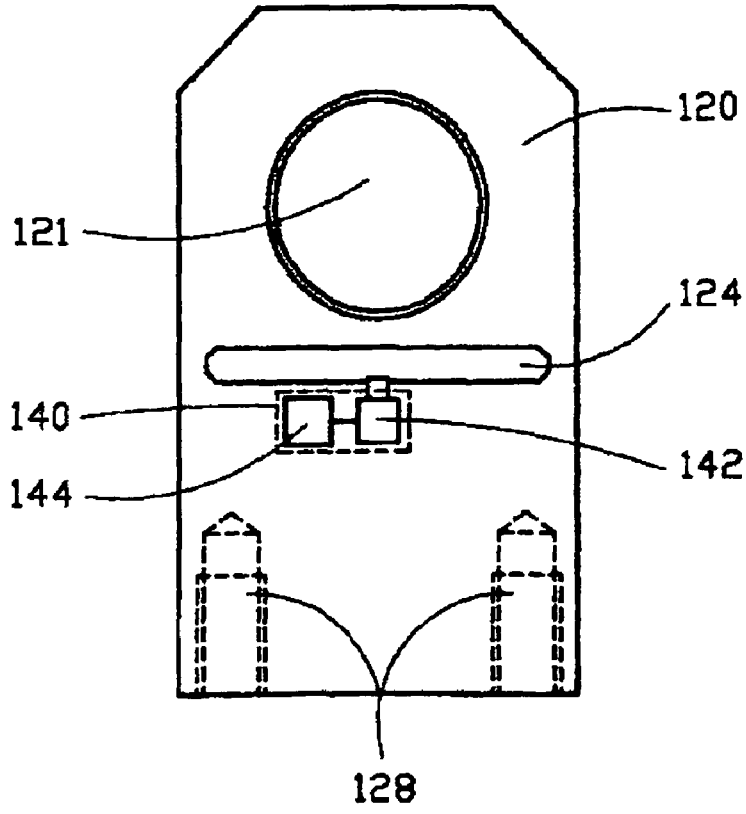
FIG. 2 shows a bearing block of the device in the unloaded state.

FIG. 2 shows a cross section through a bearing block 120. A bore 121 is formed in the bearing block 120 for supporting the rolls 130 by holding their necks. The bearing block 120 is mounted on the support apparatus 110 with bolted connections 128. The bearing block 120 has an artificial weak point 124 in the form of a slot. FIG. 2 also shows a measuring apparatus 140, which comprises a sensor unit 142 and an associated evaluation unit 144. The sensor unit 142 detects the deformation of the bearing block under load, i.e., during the guidance of the strip 200. The evaluation unit 144 computes the roll force that is sought, i.e., the force that acts on the roll 130 under load. The evaluation unit 144 calculates this roll force from the deformation of the bearing block that is detected by the sensor unit 142.

Figure 3B:
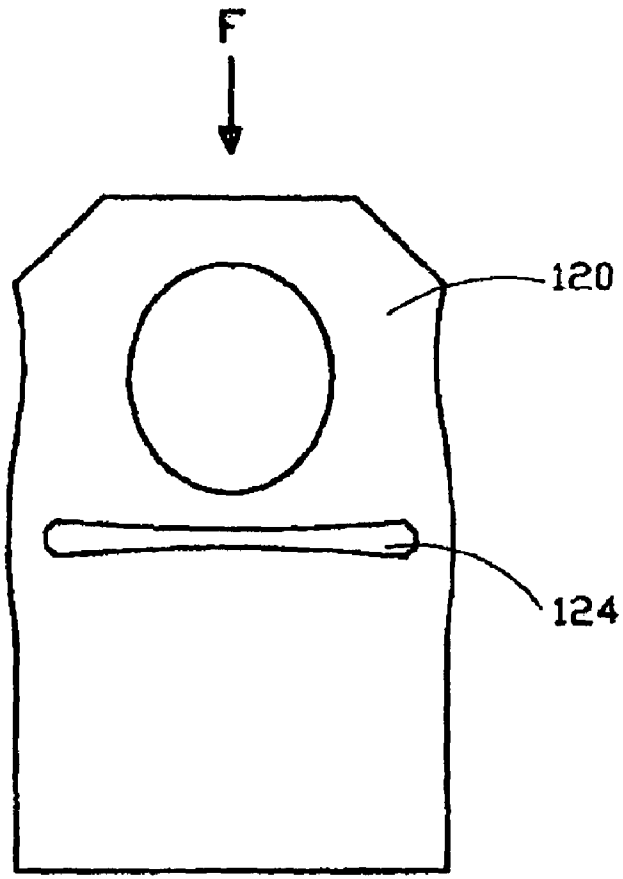
FIG. 3B shows the bearing block in the loaded state.
Figure 3A:
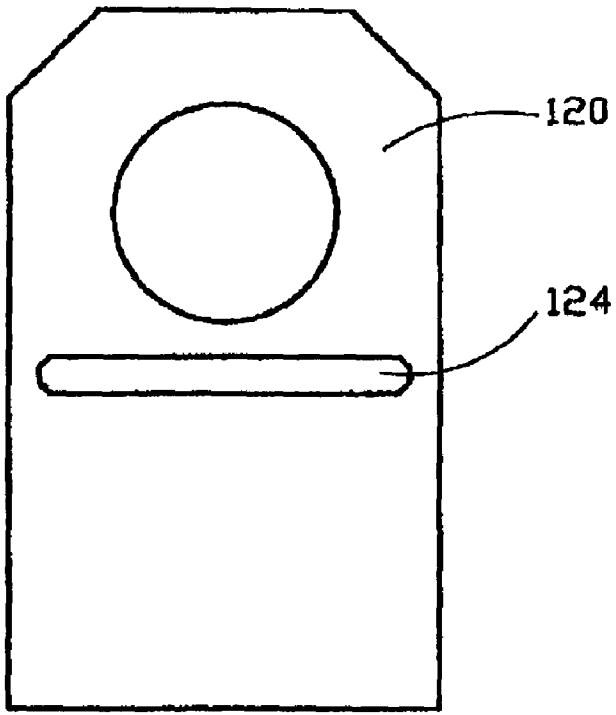
FIG. 3A shows a bearing block in the unloaded state.

FIGS. 3A and 3B show a comparison of the bearing block in the unloaded state (FIG. 3A) and in the loaded state (FIG. 3B). FIG. 3B clearly shows the deformations, especially compression, of the bearing block that results from the load F. The measuring apparatus 142 is designed as a gap sensor for the embodiments shown in FIGS. 2 and 3. It detects, preferably continuously, constriction of the slot 124 under load compared to the larger slot that is present in the unloaded state. The detected constriction of the slot 124 represents the deformation of the bearing block 120 under load. The mathematical relationship between the gap measurement signal of the gap sensor and the forces acting on the roll is determined by the characteristic of the measuring sensor and the exact geometry of the bearing block. A simple linear or almost linear relationship with polynomial components is obtained, so that the forces that are acting can be computed in a simple way from the measured deformations.

The evaluation unit 144 then uses this deformation to compute the sought force F acting on the roll under load.

FIG. 3B shows an example of the bearing block under load, with the deformation shown highly exaggerated. For example, the deformation of the bearing block in the vicinity of the weak point or the slot in a strand guide apparatus with the maximum permissible roll load is only 0.02 to 0.3 mm. Geometric variations of this magnitude can be measured without any problem and in this respect allow a sufficiently large measurement signal that represents the deformation of the bearing block.

In this regard, however, it is necessary to consider that the geometric variations of the specified order of magnitude occur only in the area of the artificially incorporated weak point; otherwise, the deformations are typically of a much smaller order of magnitude that are barely still measurable. In this respect, the weak point offers a suitable means of transforming the deformation of the bearing block to a magnitude that can be measured or of rendering the deformation visible. On the one hand, the weak point must be suitably designed for this purpose. On the other hand, however, it is also necessary to guarantee that the bearing block 120 is not weakened to an unacceptable degree by the weak point, but rather, e.g., in the case of an embodiment of the device as a strand guide apparatus, to guarantee that the deformation of the weak point remains so small that the strand shell of a slab is not subjected to an overload due to the change in the roll position under load.

The invention claimed is:

1. A device (100) for guiding a strip (200), especially a metal strip, which comprises:

at least one bearing block (120);

a roll (130) that is rotatably supported in the one or more bearing blocks and guides the strip (200); and a measuring apparatus (140) for detecting the roll force that acts on the roll during the guidance of the strip; where the measuring apparatus (140) comprises:

a sensor unit (142) for detecting the deformation of the bearing block (120) during the guidance of the strip (200); and an evaluation unit (144) for computing the roll force that acts on the roll (130) from the deformation of the bearing block detected by the sensor unit (142), wherein the bearing block (120), whose deformation is being measured, has a cavity (122) or a recess, at least one of the sensor unit (142) and the evaluation unit (144) being mounted in the cavity.

2. A device (100) in accordance with claim 1, wherein the sensor unit (142) is designed in the form of an ultrasonic sensor, an eddy-current sensor, a fiber-optic gap sensor, or a test probe.

3. A device (100) in accordance with claim 1, wherein the bearing block (120), whose deformation is to be measured, has a suitable weak point (124), whose own deformation during the guidance of the strip (200) can be detected by the sensor unit (142) as representative of the deformation of the bearing block (120).

4. A device (100) in accordance with claim 3, wherein the weak point (124) is designed as a slot, which is arranged in such a way in the bearing block (120), preferably in the vicinity of a bore (126) for holding the roll neck, that it deforms during the guidance of the strip.

5. A device (100) in accordance with claim 4, wherein the sensor unit is a gap sensor (142) arranged for detecting deformation of the slot during the guidance of the strip.

6. A device (100) in accordance with claim 1, wherein the bearing block is mounted on a support apparatus (110), the device (100) is designed as a strand guide apparatus, the support apparatus (110) is designed as a segmented frame, and the roll (136) is designed as a segmented roll for guiding the strip in the form of a metal strip, especially a slab, from an upstream casting installation.

7. A device (100) in accordance with claim 1, wherein the bearing block is mounted on a support apparatus (110), the device (100) is designed as a rolling stand, the support apparatus (110) is designed as a housing, and the roll (136) is designed as a work roll or back-up roll for guiding and rolling the strip (200) in the form of a metal strip.

8. A device (100) in accordance with claim 1, wherein the device (100) is designed as a looper for the temporary storage of parts of the strip (200).

* * * * *